US005950374A

United States Patent [19]

Gromat

[11] Patent Number: 5,950,374

[45] Date of Patent: Sep. 14, 1999

[54] PREFABRICATED BUILDING SYSTEMS

[75] Inventor: Johannes Gromat, Hill End, Australia

[73] Assignee: Leftminster Pty Ltd., Queensland, Australia

[21] Appl. No.: 08/591,487

[22] PCT Filed: Jun. 17, 1994

[86] PCT No.: PCT/AU94/00335

§ 371 Date: Mar. 8, 1996

§ 102(e) Date: Mar. 8, 1996

[87] PCT Pub. No.: WO95/02097

PCT Pub. Date: Jan. 19, 1995

[30] Foreign Application Priority Data

Jul. 8, 1993 [AU] Australia ..... PL9876

[51] Int. Cl.[6] ..... E04B 7/04

[52] U.S. Cl. ..... 52/93.2; 52/653.2; 52/79.1; 52/272

[58] Field of Search ..... 52/93.1, 93.2, 52/653.1, 79.2, 79.1, 654.1, 655.1, 656.9, 278, 279, 276, 712, 636, 645, 647, 650.2, 79.13, 653.2, 637, 271, 236.7; 403/382, 346, 347, 292–300

[56] References Cited

U.S. PATENT DOCUMENTS

| | | | |
|---|---|---|---|
| 1,835,524 | 12/1931 | Rinehart et al. | 52/236.7 |
| 1,857,326 | 5/1932 | Porterson | 403/169 |
| 2,076,726 | 4/1937 | Keller | 52/236.7 X |
| 2,129,441 | 9/1938 | Otto | 52/271 |
| 3,146,864 | 9/1964 | Nystrom et al. | 52/93.2 |
| 3,919,819 | 11/1975 | Oliver | 403/382 X |
| 4,041,659 | 8/1977 | McElhoe | 52/93.1 |
| 4,133,151 | 1/1979 | Burvall | 52/93.1 |
| 4,184,296 | 1/1980 | Vitalini | 52/236.7 X |
| 4,205,497 | 6/1980 | Schirm | 52/93.2 |
| 4,551,957 | 11/1985 | Madroy | 403/170 X |
| 4,559,748 | 12/1985 | Ressel | 52/93.2 |
| 4,610,114 | 9/1986 | Rodriquez | 52/93.1 |
| 4,773,192 | 9/1988 | Andrews | 52/93.1 |
| 4,809,480 | 3/1989 | Hale | 52/93.1 X |
| 5,285,612 | 2/1994 | Johnson | 52/655.1 |
| 5,497,591 | 3/1996 | Nelson | 52/93.1 |
| 5,579,621 | 12/1996 | Fang | 52/656.9 X |
| 5,600,924 | 2/1997 | Forsberg | 52/93.1 X |

FOREIGN PATENT DOCUMENTS

| | | | |
|---|---|---|---|
| 7003634 | 6/1987 | United Kingdom | 52/93.2 |

*Primary Examiner*—Carl D. Friedman
*Assistant Examiner*—Brian E. Glessner
*Attorney, Agent, or Firm*—Lowe Hauptman Gopstein Gilman & Berner

[57] ABSTRACT

A building structure formed from transportable prefabricated panel frame section is disclosed. The building structure includes wall and/or floor and/or roof frames. Each wall frame is formed from a plurality of similar wall panel frame sections having frame side members. The wall panel frame sections are arranged in the wall frame with the frame side members of adjacent wall panel frame sections spaced apart. A joining member is located between adjacent frame side members and rigidly fastens the frame side members to one another. Each joining member extends vertically beyond the side frame members for interconnecting the side frame members therebelow to a floor frame and/or a roof frame and/or another wall frame thereabove.

13 Claims, 22 Drawing Sheets

PREFABRICATED BUILDING SYSTEMS

BACKGROUND OF THE INVENTION

This invention relates to building structures and the constructing and erection of prefabricated buildings.

In particular this invention relates to prefabricated buildings utilising prefabricated steel framing and especially framing constructed from rectangular hollow section frame members. However other section metal frame members may be utilized such as open channel, I-section and Z-sections and the like, where suitable.

Many construction methods have been proposed to provide a simple and cost effective steel framing system for buildings to take advantage of the characteristics of steel fabrication which facilitates accurate factory prefabrication. The latter feature provides the potential to supply bolt together frames which may be erected on site in a relatively short time by relatively unskilled labour and to provide an open structure supporting a roof beneath which the subsequent building operations such as adding the services and finishes, may be carried out under cover of the supported roof.

While many methods have been proposed and some have been commercialised, factory prefabrication of frames and on site bolt together style erection has not as yet provided sufficient benefit to builders to seriously challenge conventional on site timber construction techniques as the predominant construction method for dwellings.

A further disadvantage with the presently used construction methods is that it is difficult to modify existing stock plans to sit individual requirements and at the same time be able to readily provide an accurate estimation of the cost of construction of a new structure. Ready cost estimation is even more difficult where a design layout is prepared to individual requirements.

SUMMARY OF THE INVENTION

The present invention aims to alleviate at least one of the above disadvantages and to provide improvements in building structures and the constructing and erection of prefabricated buildings which will be reliable and efficient in use.

With the foregoing in view, this invention in one aspect resides broadly in a building structure formed from transportable prefabricated panel frame sections including wall and/or floor and/or roof panel frames, the wall frames being formed from a plurality of similar wall panel frame sections each having frame side members and said wall panel frame sections being arranged with the frame side members of adjacent wall panel frame sections in spaced relationship whereby side panel frame sections may be interconnected to joining members positioned between said frame side members.

The frame side members suitably include upright member which extend between the upper and lower extremities of the panel frame sections providing load paths at the extremities of segments permitting roof, wall and floor loads to be transferred directly to footings or floor support means. However if desired the frame side members may be respective upper and lower fabrications associated with the ends of the panel frame sections and protruding from the ends thereof. The joining members are preferably independent of the frame sections but may be formed integrally with the panel frame sections if desired.

Preferably the transportable prefabricated floor and roof frames are also formed from a plurality of similar panel frame sections each having frame side members arranged in closely spaced relationship whereby they may be interconnected to joining members positioned therebetween and suitably to common joining members which tie the floor walls and roof frames together. It is also preferred that the floor and wall panel frame sections are rectangular frame sections and have common dimensions between frame side members such that the spaces between interconnected floor and wall panel sections may be medially intersected by respective vertical grid planes extending at right angles to the panel frame sections. This arrangement enables building structures to be stably erected segmentally, with segment widths corresponding to the widths of the panel frame sections.

It is also preferred that the widths of the panel frame sections be equal to the effective span of a roofing sheet or multiples thereof whereby roof panel frame sections may be covered with roofing sheets which operatively overlap in a weatherproof relationship across the grid planes. This facilitates factory fabrication of standard width roofed panel frame sections and provides a grid which can be followed for wall lines which will not cause mismatching of roofing profiles of the roofing which may be supplied fixed to the roof panel frame sections in a uniform manner for all structures following the grid. Furthermore where the panel frame sections are formed as ladder type frames, the rung frame members may be standardised in length for all wall and floor frames and the longer frame members for all correspondingly pitched roof panel frame members may also be standardised.

It is preferred that the floor, wall and roof panel frame sections include continuous frame side members extending adjacent the respective vertical grid planes.

In the preferred embodiment of the invention the joining members are plates sandwiched between the frame side members. The joining members being formed with threaded apertures extending therethrough and into which opposing bolts passing through adjacent frame side members in adjacent panel frame sections may extend to interconnect the adjacent panel frame sections to the joining members. Suitably the frame side members are rectangular suction members and the joining members have a thickness equal to one-half the thickness of the rectangular section members. This arrangement maintains concentricity of load paths in joining frames at corner connections. Alternatively the joining members may be plate-like members provided with studs projecting therefrom and through apertures formed in the panel frame sections. Of course other forms of mechanical fasteners may be used in lieu of bolted connections.

It is also preferred that the frame side members are hollow box section members or incorporate hollow box section members at their junction with the joining members and that the connecting bolts are threaded into the threaded apertures in the joining members only through the adjacent wall of the box section members. However if desired longer bolts with tubular compression spaces may extend fully through the frame side members. It is further preferred that the panel frame sections be formed with a plurality of traverse or rung members thereof being stiff members attached by a torsionally rigid connection to the frame side members so as to obviate the need for diagonal bracing, diagonal bracing being provided by moment transfer between the frame side members and the rung members.

If desired a building frame may be erected, supported on a temporary platform whereafter the floor support posts may be suspended from the joining members and subsequently secured in a suitable footing. Thereafter the temporary platform may be dismantled to leave the building structure supported by the posts. Alternatively wall frame sections may be used in lieu of posts for supporting elevated floor frame sections.

In another aspect this invention resides broadly in a method of providing individually designed structures, the method including:

providing a wall grid having grid line spacings equal to the effective cover width of standard roofing panels;

designing the floor plan by arranging all external supporting walls to lie along a grid line, and designing a roof layout with all valley lines and ridge lines extending along a grid line or a diagonal of the grid.

In yet a further aspect this invention resides broadly in a method of forming a valley gutter including:

providing a respective flashing tray under the extremity of the adjacent downwardly converging roofing sheets or tiles;

forming each flashing tray with an upturned flange along its outer exposed edge, and providing a capping member to extend over the adjacent upturned flanges in the valley.

BRIEF DESCRIPTION OF THE DRAWINGS

In order that this invention may be more readily understood and put into practical effect, reference will now be made to the accompanying drawings which illustrate typical embodiments of the present invention and wherein.

DESCRIPTION OF THE PREFERRED EMBODIMENT

Figure 1:
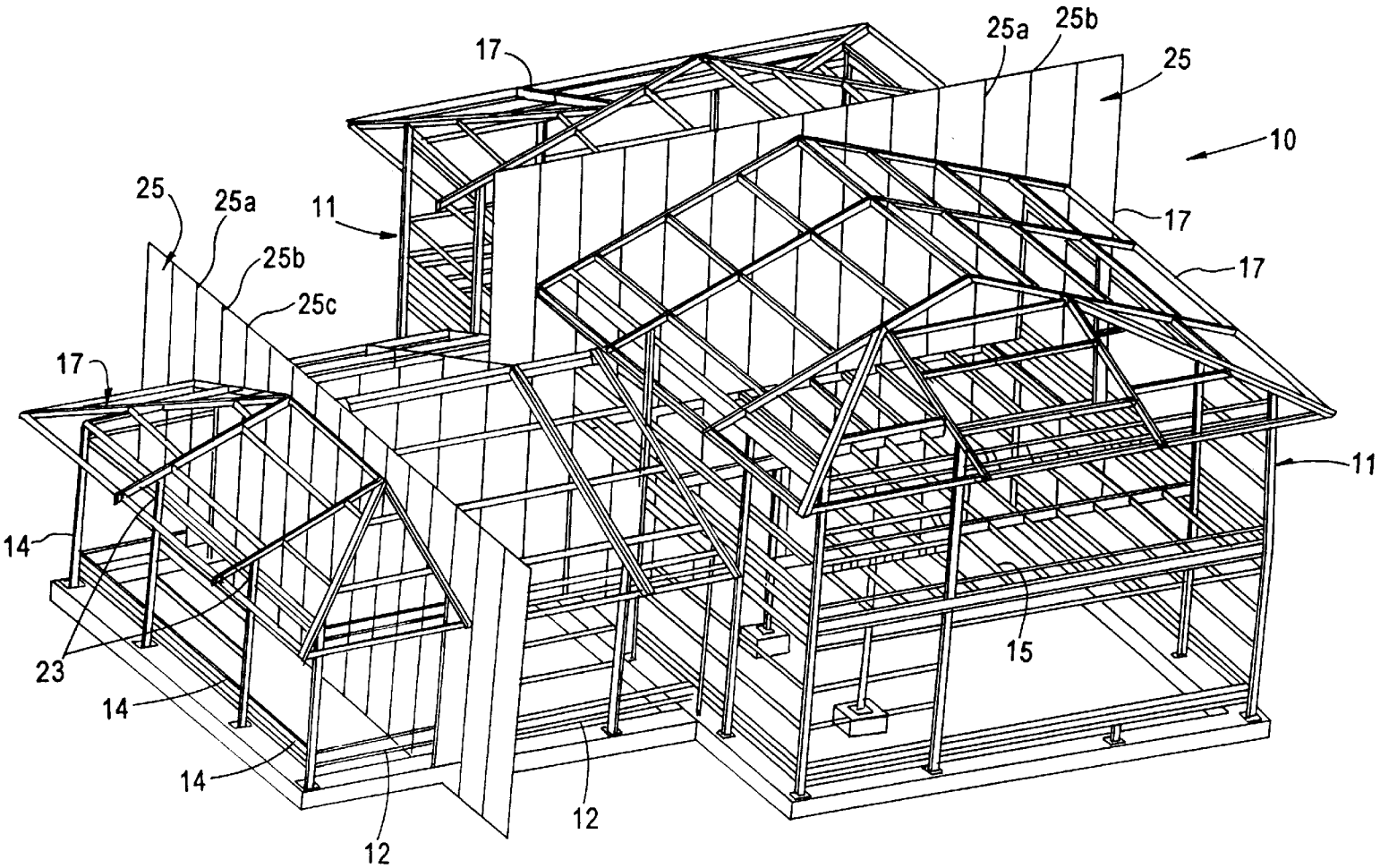
FIG. 1 is a perspective view of a part completed building structure.

Illustrated a typical building structure 10 according to the present invention includes perimeter wall frames 11 constituted in the illustrated embodiment by side wall panel frame sections 12 and end wall panel frame sections 14. The building structure also includes floor panel frame sections 15, ceiling panel frame sections 16 and complementary roof panel frame sections 17. The latter extend upwardly from the opposed longitudinal side edges 23 of the ceiling panel frame sections 16 and wall panel frame sections 12 and are supported by bracing members 18 which cooperate with the corresponding ceiling frame sections and roof panel sections to for a truss-like roof Structure, as illustrated in FIG. 15.

Figure 12:
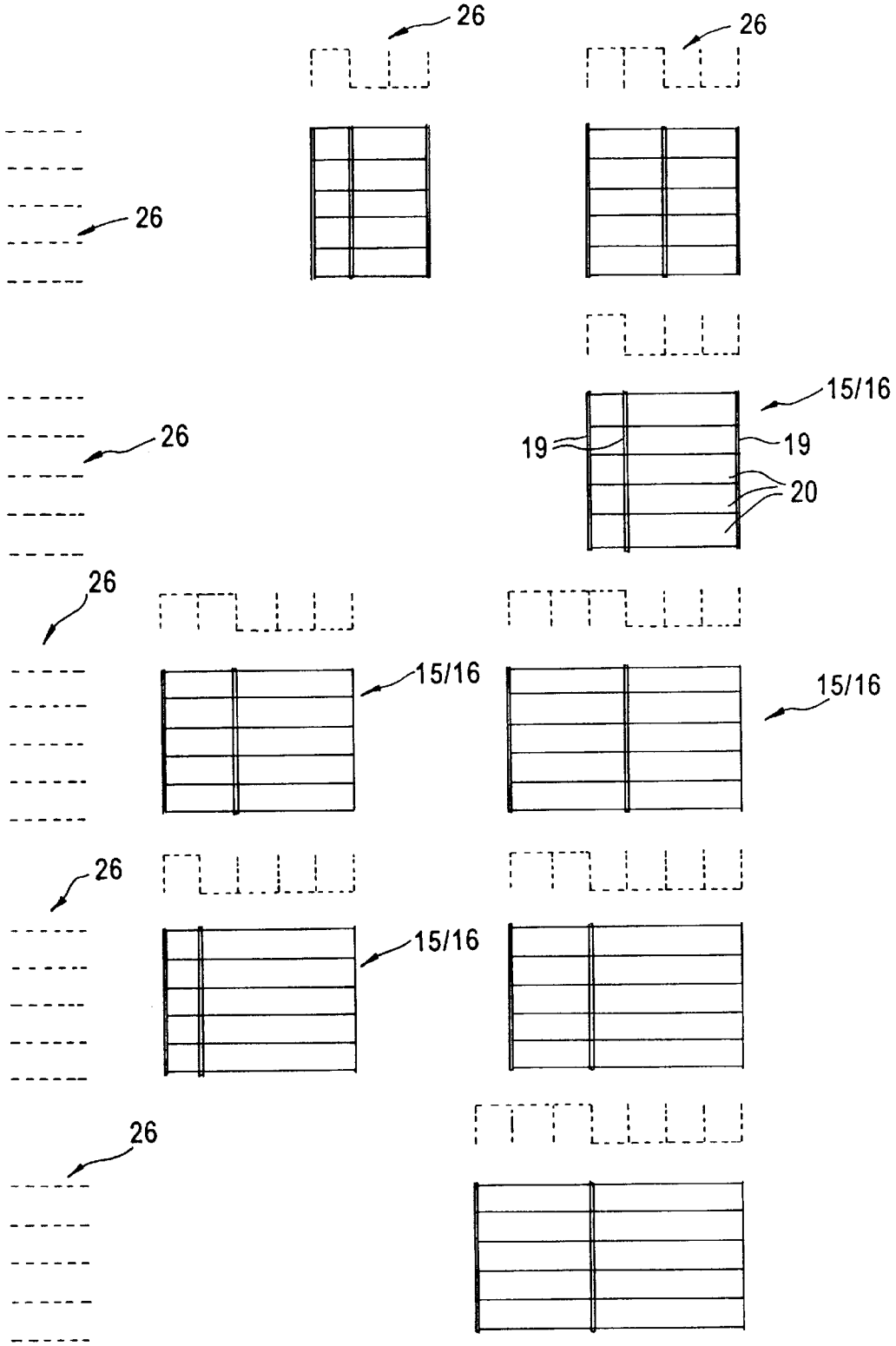
FIG. 12 illustrates combinations of floor frames and corresponding grid lines.
Figure 13:
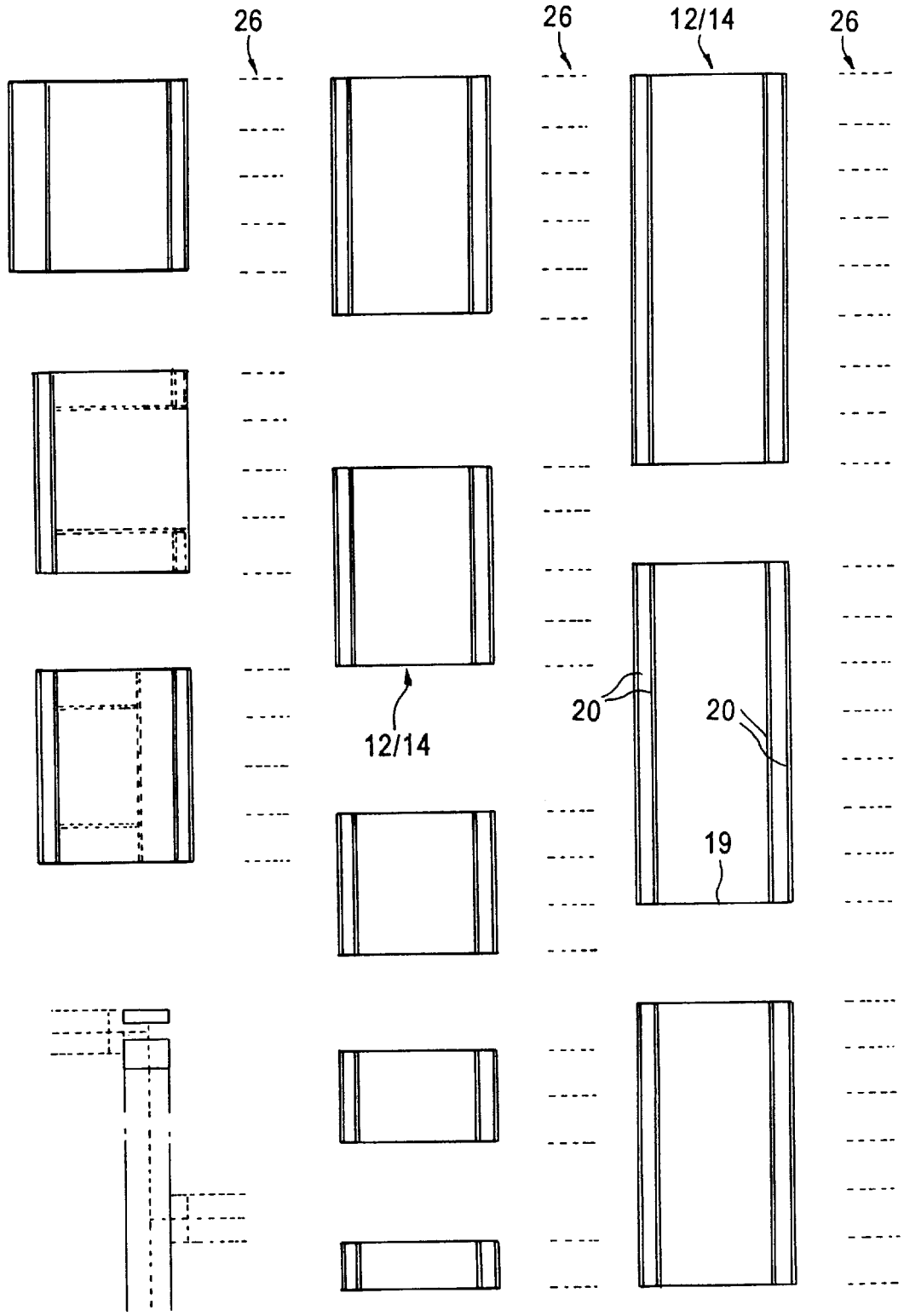
FIG. 13 illustrates combinations of wall frames end corresponding grid lines.
Figure 14:
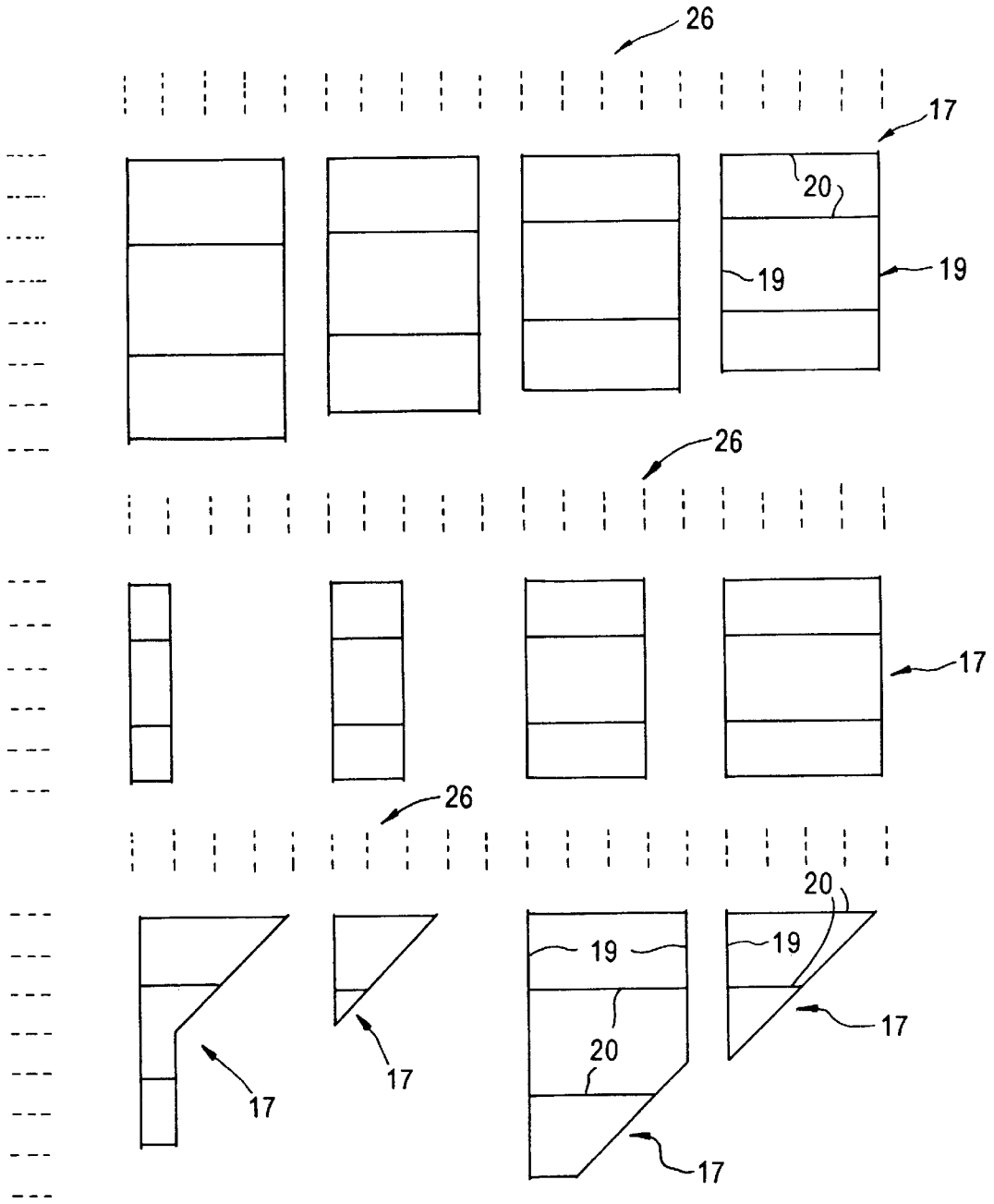
FIG. 14 illustrates combination of roof panel frame sections and corresponding grid lines.
Figure 15A:
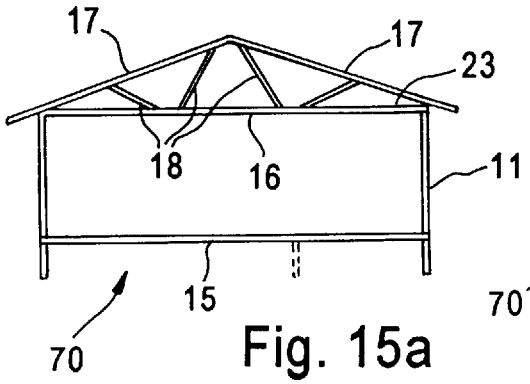
FIGS. 15(*a*) to 15(*e*) illustrates various roof framing structures which may be utilised.
Figure 15C:
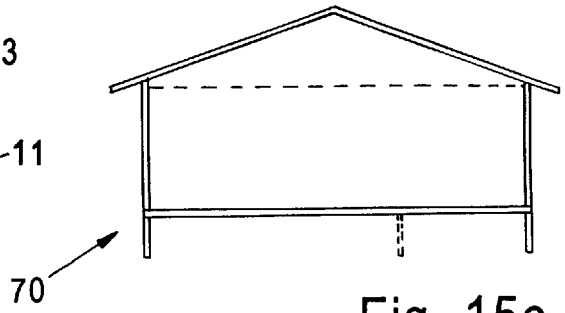
Figure 15B:
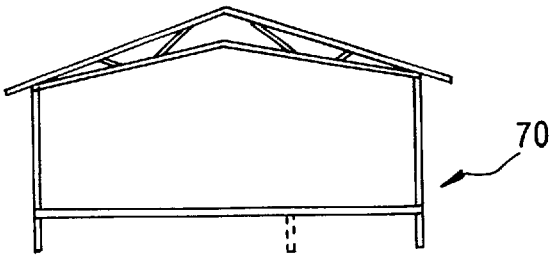
Figure 15D:
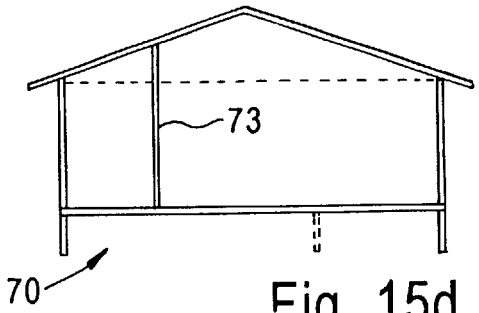
Figure 15E:
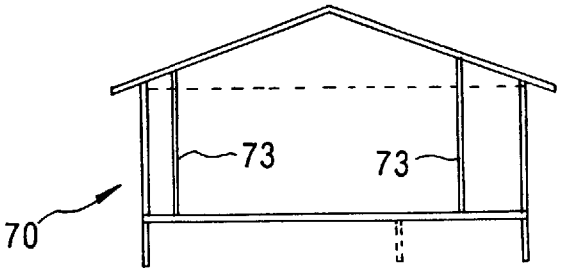

As illustrated in FIGS. 12, 13 and 14 all panel frame sections are factory formed as welded unitary ladder frame having side frame members 19 interconnected by rung frame members 20. In a structure, as best illustrated in FIGS. 2 to 5, the frame side members 19 of each floor, wall and roof frames are spaced apart by an interposed joining member 21 provided with threaded apertures 22 each of which receives opposing bolts 23 extending through the adjacent walls 24 of the wall and floor frame sections 14 and 15. The bolts are located on the centreline between the opposed panel mounting faces of the panel frame sections so that each panel frame section may be used as a right hand or left hand panel frame section.

It will be seen from the drawings that the building structure 10 comprises a plurality of juxtapositioned structural building segments bolted together to provide the complete frame structure 10. The basic components of each structural building segment are wall, floor and roof panel frame sections 12, 14, 15 and 17 which may be erected individually as a self standing structure.

Suitably the first erected segment is an end segment having side and end wall panel frame sections. The structure 10 is completed by sequentially erecting the next adjacent segment, and securing it to the last erected segment in the process. It will also be seen that the segments terminate and adjoin at respective vertical grid planes, illustrated typically at 25*a* and 25*b* extending at right angles to the panel frame sections 12, 14, 15, 16 and 17 and which grid planes 25 extend medially through the space between segments which is utilized to house the joining members 21. The grid planes are illustrated with intersecting grid lines 25*c* marked thereon. The flooring 13 is supported along all edges by the rung members 20 and the inner edge of the respective frame side members 19.

Referring to FIGS. 12, 13 and 14 it will be seen that the panel frame sections 12, 15, 16 and 17 in each segment are of equal width so as to terminate adjacent a grid plane and are substantially equal to one or a multiple of the grid spaces, the grid lines 26 being indicated in dotted outline.

The frame side members 19 are through bolted together by being bolted to common joining members 21 sandwiched between the side members 19 of the frame sections 12, 15, 16 and 17. The joining members 21 are plate steel members provided with threaded apertures 22 extending fully therethrough so as to receive opposing bolts 20 at the opposite ends thereof, each joining a respective panel frame section in abutting relationship to one side of the joining members 21 and thus together through the joining members 21.

It will also be seen that the panel frame sections 12, 14, 15, and 16 have continuous box section frame side members 19 extending across the opposite sides of the frame sections and common length box section rung members 20 extending therebetween and welded thereto so as to provide a structure which is rigid and resists loxenging, requiring no diagonal bracing for this purpose. The frame side members 19 extend adjacent the vertical grid planes and when operatively interconnected by the joining members 21 provide efficient substantially straight-line load paths for transferring roof, wall and floor loads directly to the floor support.

The connection details between segments is illustrated in FIG. 2. As shown in FIG. 2*b,* lower panel frame sections 12 are interconnected at their upper ends by being through bolted, through the apertures 30 in their outer walls 24, to a full thickness joining plate 21 which extends upwardly between the adjacent floor panel frame sections 15 which are bolted thereto through the lower pair of apertures 32. As illustrated in FIG. 2*c,* the upper pairs of apertures 33 are through bolted to half thickness plates 34 which extend upwardly to secure the lower ends of the next uppermost wall panel frame sections 12 thereto.

Figure 2B:
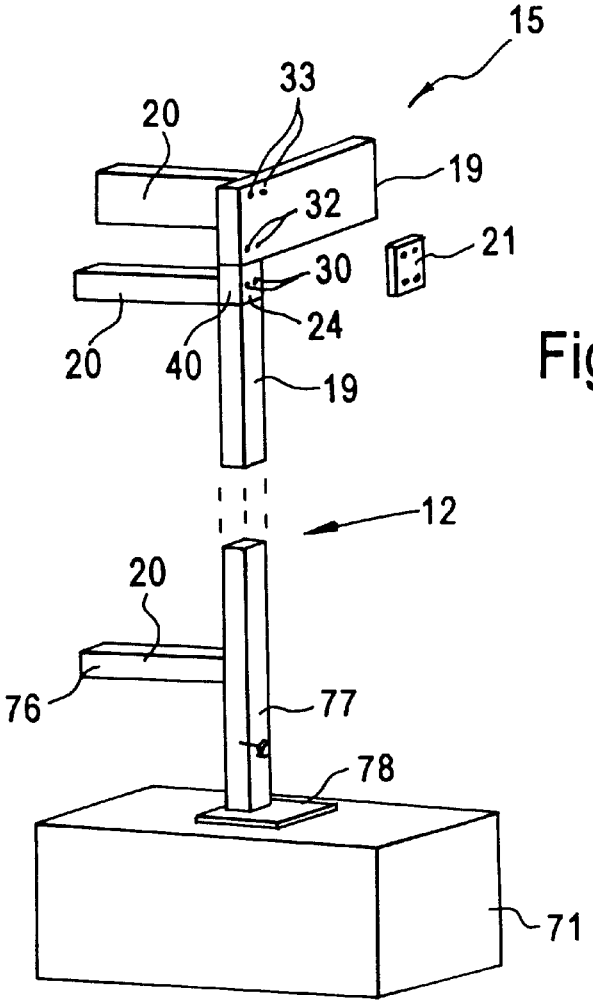
FIGS. 2(*a*) to 2(*f*) are a series of views illustrating a preferred form of frame construction technique of the present invention.
Figure 2A:
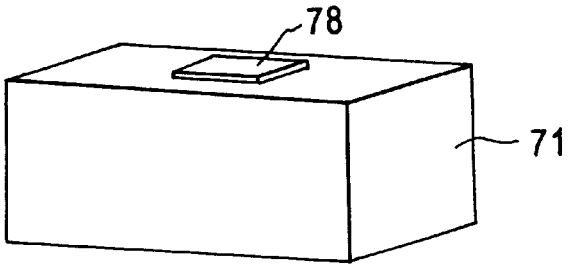
Figure 2C:
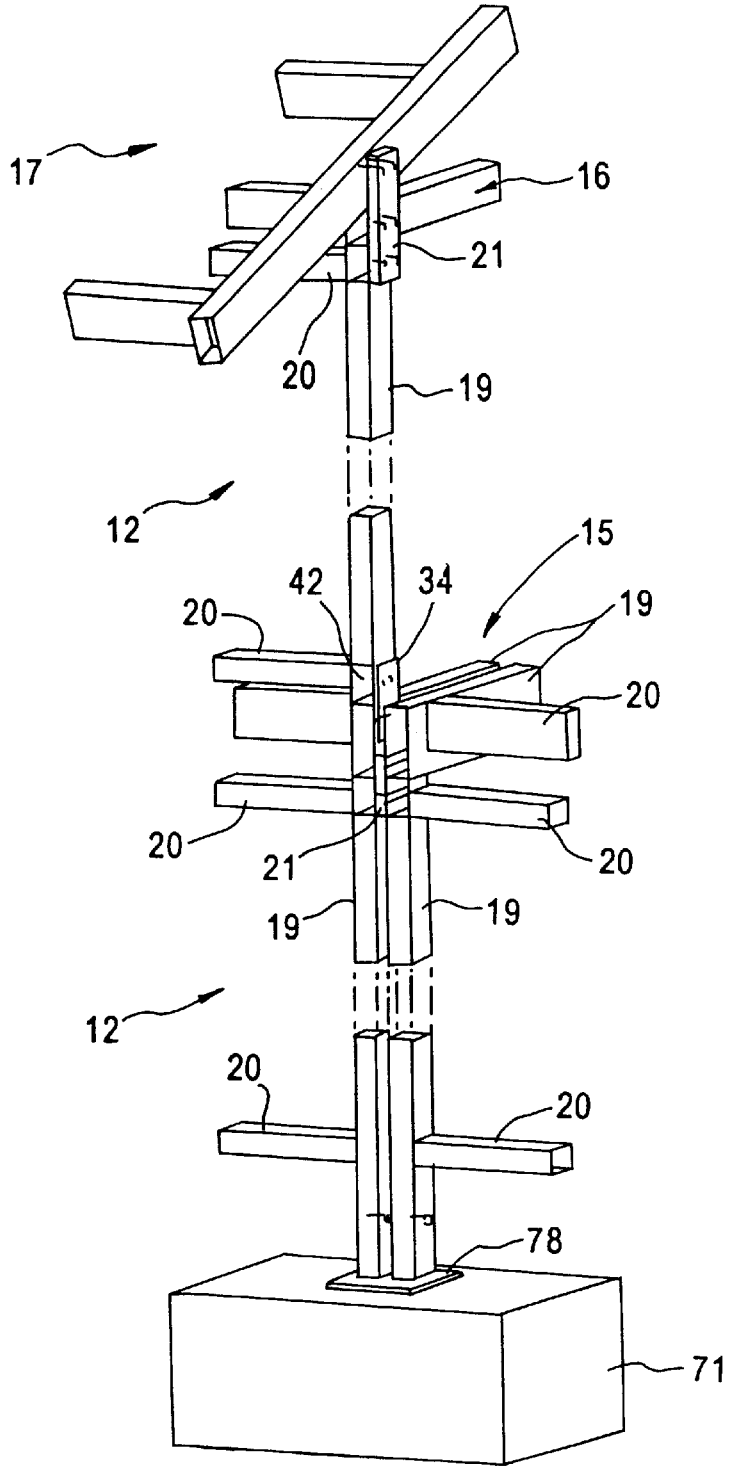
Figure 2D:
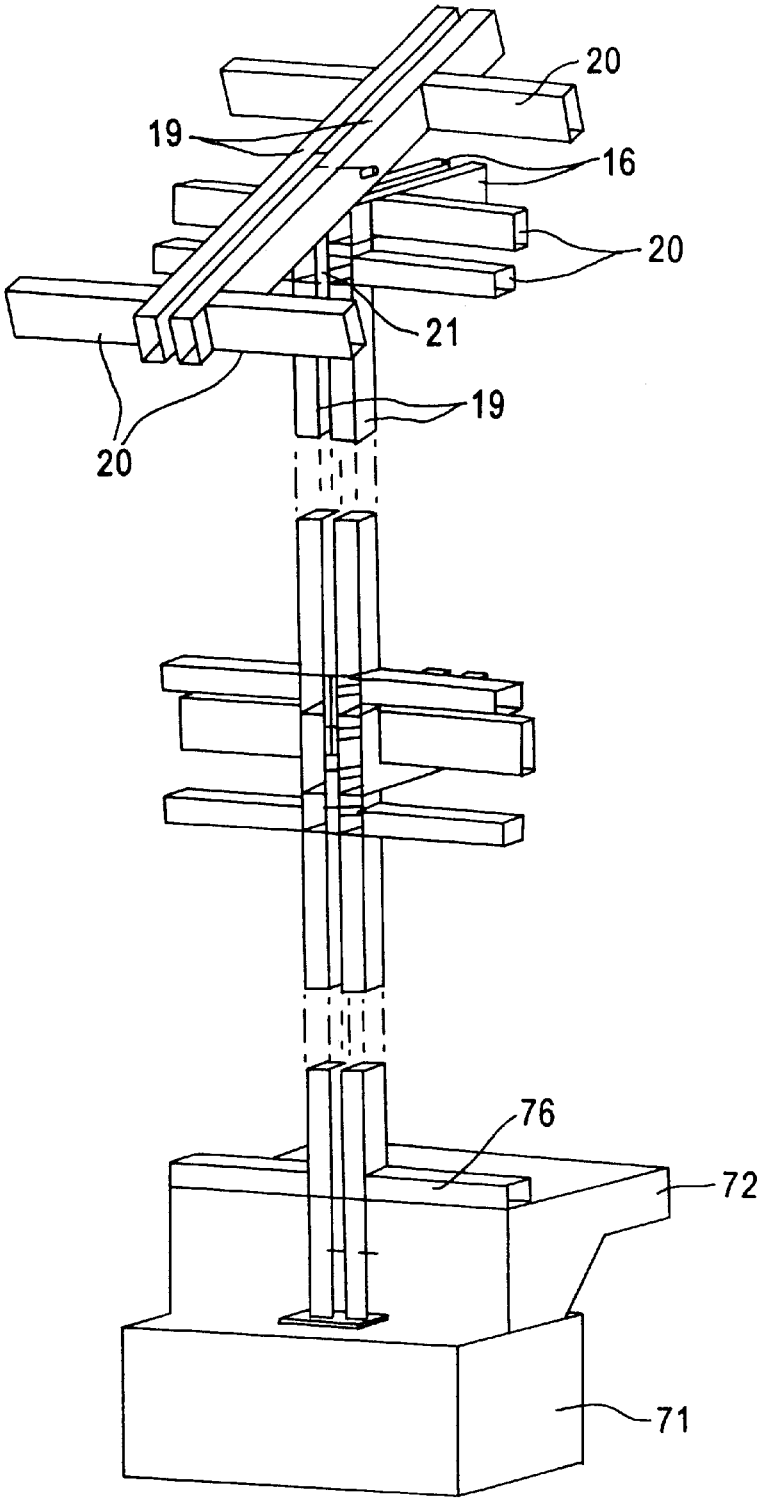
Figure 2E:
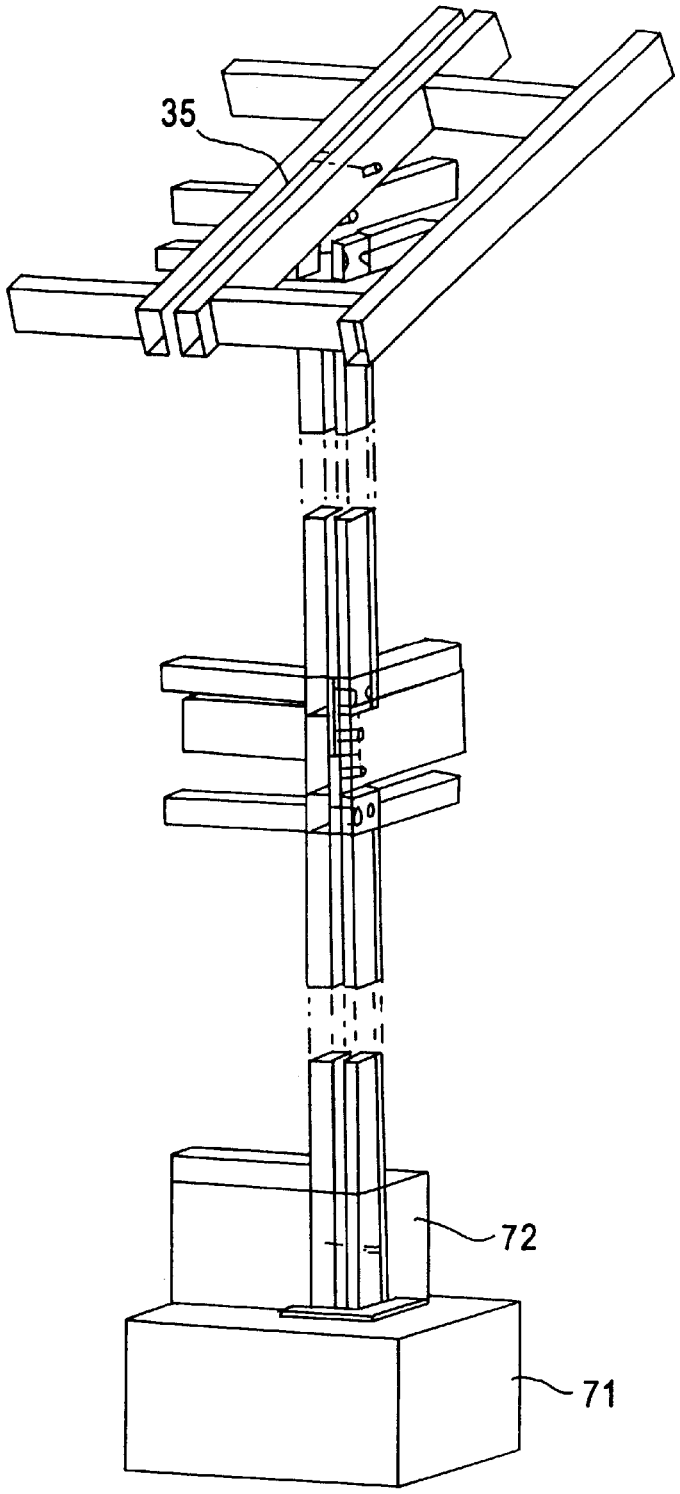

A corner joint detail is illustrated in FIG. 2*e*. It will be seen that the corner frame side members 19 are fabricated from a full width and half width box section members to provide an internal angle which extends around the inner corner of the adjacent end frame side member 19, maintaining the joining members 19 at the centre of the and wall panel frame sections 14.

It will also be seen that the wall panel frame sections are provided with integral box-section stub-members as illustrated at 40 and 42 which open outwardly to facilitate ease of joining the wall panel frame sections to joining plates, and for this purpose to provide access to the bolt apertures therethrough. This construction also facilitates production as the stub-members may be predrilled as small components ready for welding into a standard panel frame section.

Figure 5A:
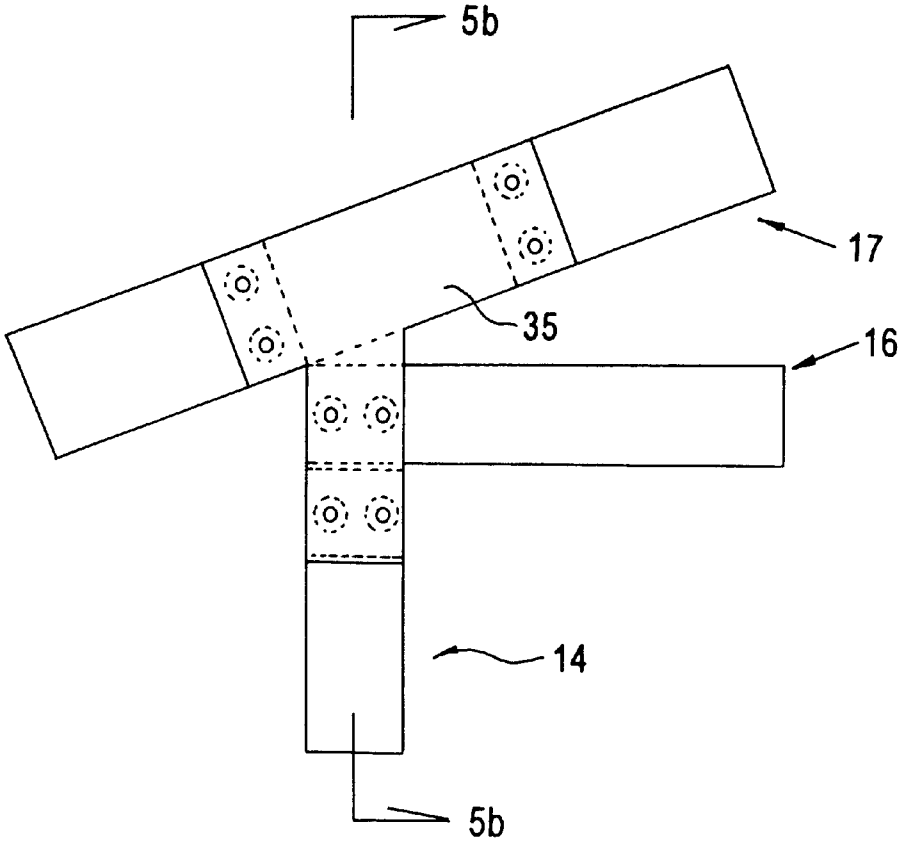
FIGS. 5*a*, 5*b*,and 6*a*, and 6*b* illustrate roof and roof wall joining members.
Figure 5B:
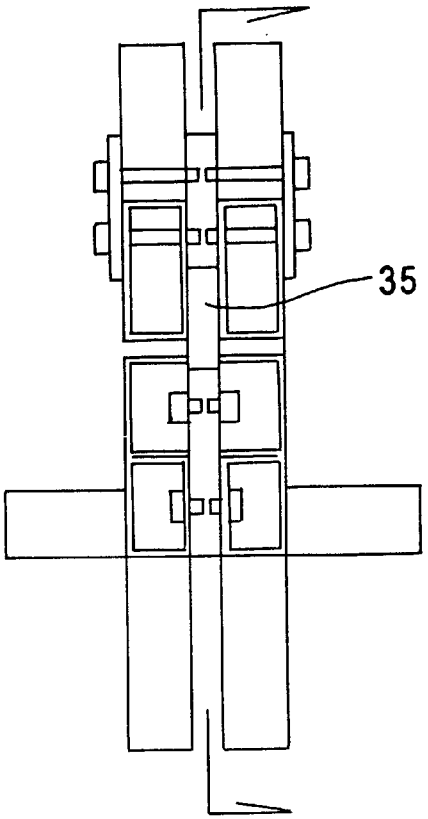
Figure 6B:
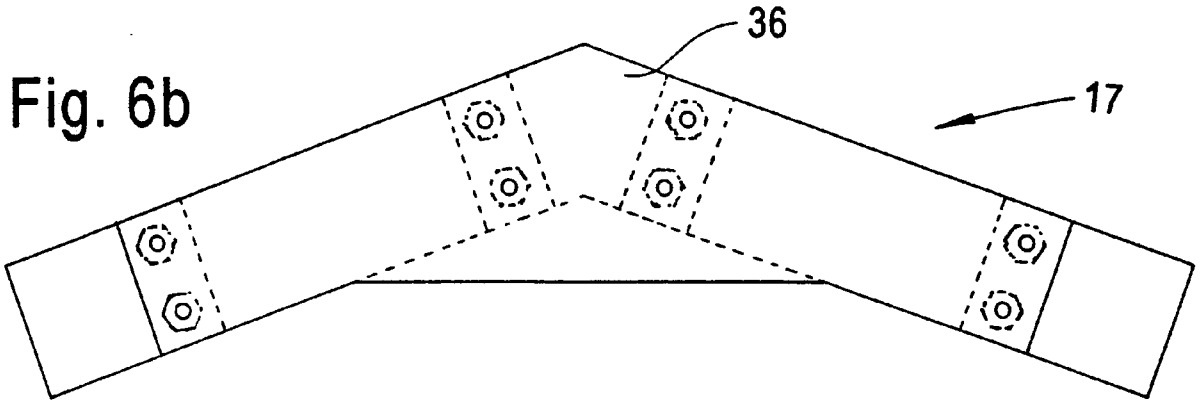
Figure 6A:
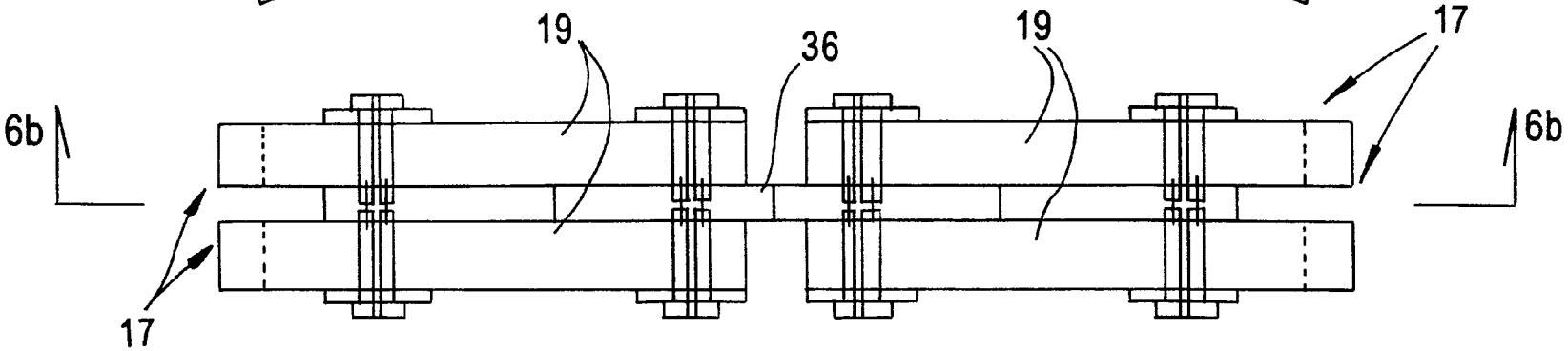

Further full thickness T-plates 35 join the upper ends of the uppermost wall panel frame sections 12 together and provide inclined apertured top plates for joining the roof panel frame sections 17 thereto. These joining members 35 and roof peak joining members 36 are illustrated in FIGS. 5 and 6. The bolting apertures are provided on the centrelines of the frame side members 19 and are identical in form to enable standardization of components to be achieved.

Figure 3:
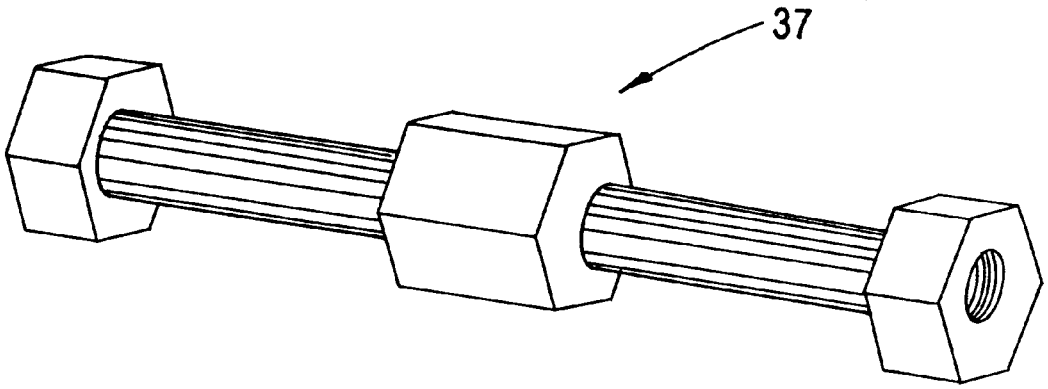
FIG. 3 illustrates a typical frame spacer.
Figure 4B:
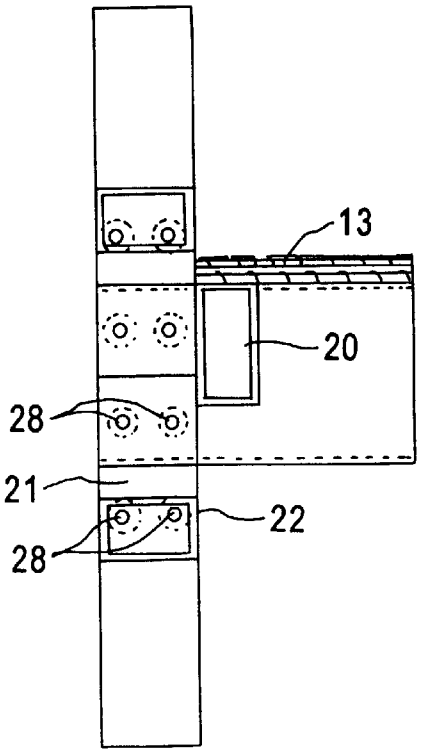
FIG. 4*a* and 4*b* illustrates a typical elevated floor joint.
Figure 4A:
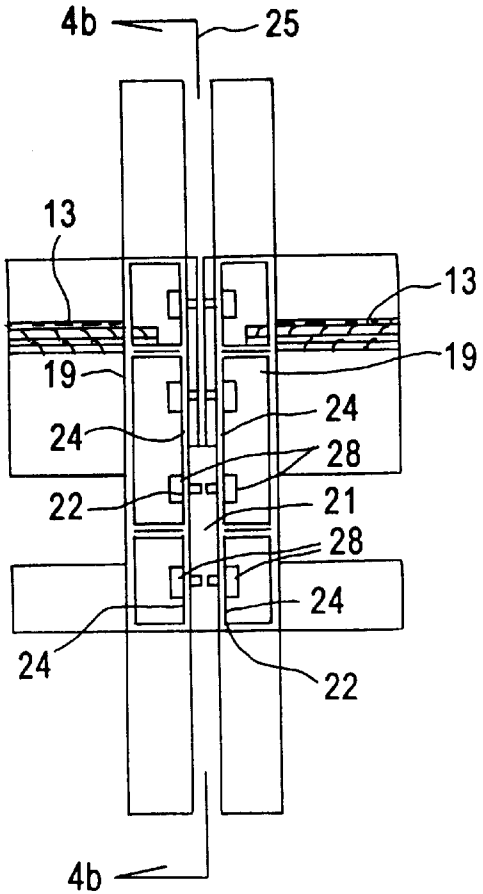

Intermediate joints are made along the length of the frame members 19 by the joining stud assemblies 37 illustrated in FIG. 3. These assemblies 37 have a spacer central section equal In length to the space between frame side members 19 and threaded studs extending from each end. These and other joining members are all located in the space between the frame side members 19 of adjacent panel frame sections and are all intersected by a respective vertical grid plane.

Figure 9:
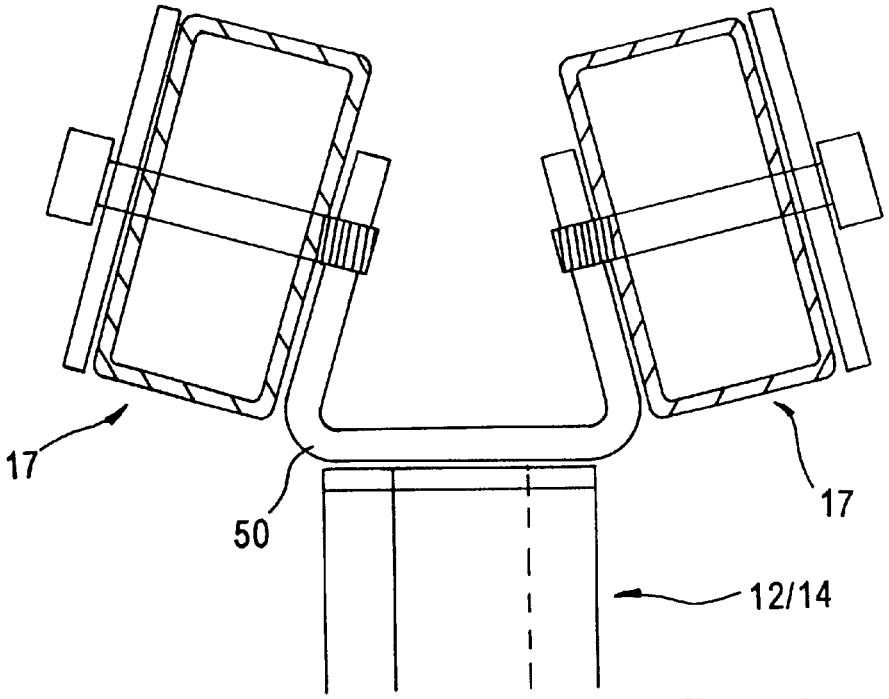
FIGS. 8 and 9 illustrate wall to roof ridge and valley connections.
Figure 8:
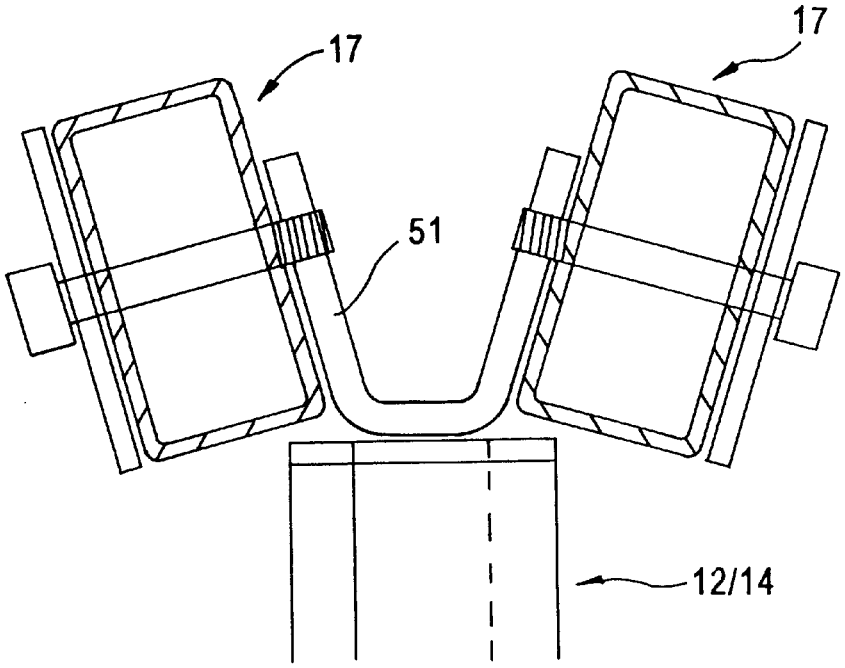

At internal and external corners producing roof valleys and ridges, the U-shaped mounting brackets 50 end 51 illustrated in FIGS. 8 and 9 are utilised to join the roof panel frame sections 17 to the wall panel frame sections 12/14. It will be seen that these mounting brackets 50 and 51, as with all joining brackets, join to panel frame sections having right angle external corners which are square to the opposed face planes of the panel frame sections. Thus all frames may be formed on a flat bed with the side faces of all box-section members normal to the flat bed. Suitably the bolt apertures in the panel frame sections provide locations for accurately jigging the steel frame components for welding and commonality of components is exhibited throughout the structure.

Figure 10:
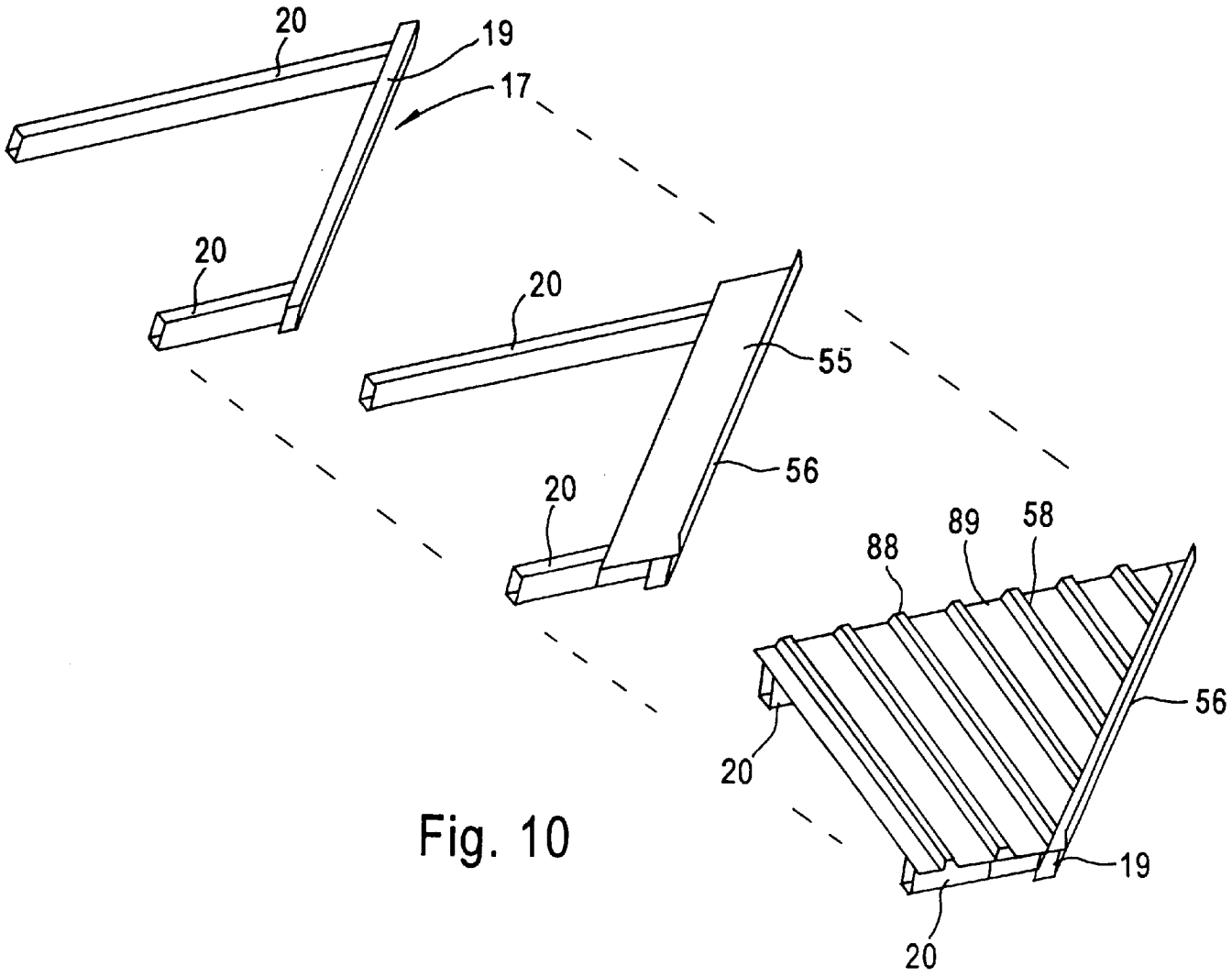
FIGS. 10 and 11 illustrate a valley junction.
Figure 11:
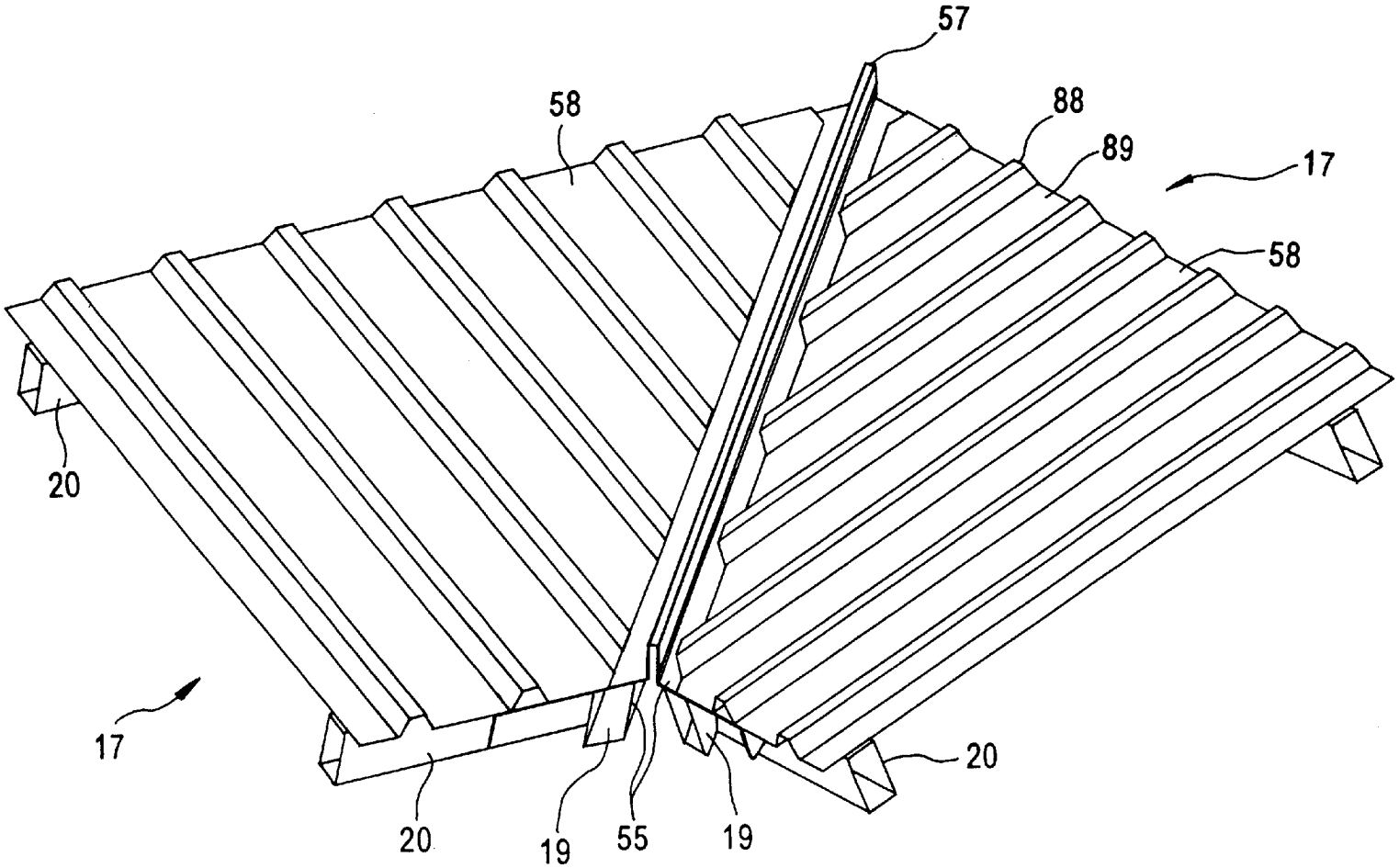

Ridges are capped in conventional manner and valleys are for as illustrated in FIGS. 10 and 11. Valleys are formed by securing a broad Z-section member 55 to the frame side members 19 with one upturned flange 56 extending upwardly adjacent the respective frame side member 19 and the other downturned flange notched to gage about the rung frame members 20. The adjacent upturned flanges 56 of adjacent members 55 are capped by an inverted channel shaped section 57 which is bonded in place by a suitable mastic or sealant or the like. The roof sheeting 58, which is suitably attached to the roof panel frame sections 17 in the factory, together with the broad Z-section member 55, extends thereacross to a position adjacent the upturned flange 56. The only on-site forming being the capping of the adjacent flanges 56.

Figure 7:
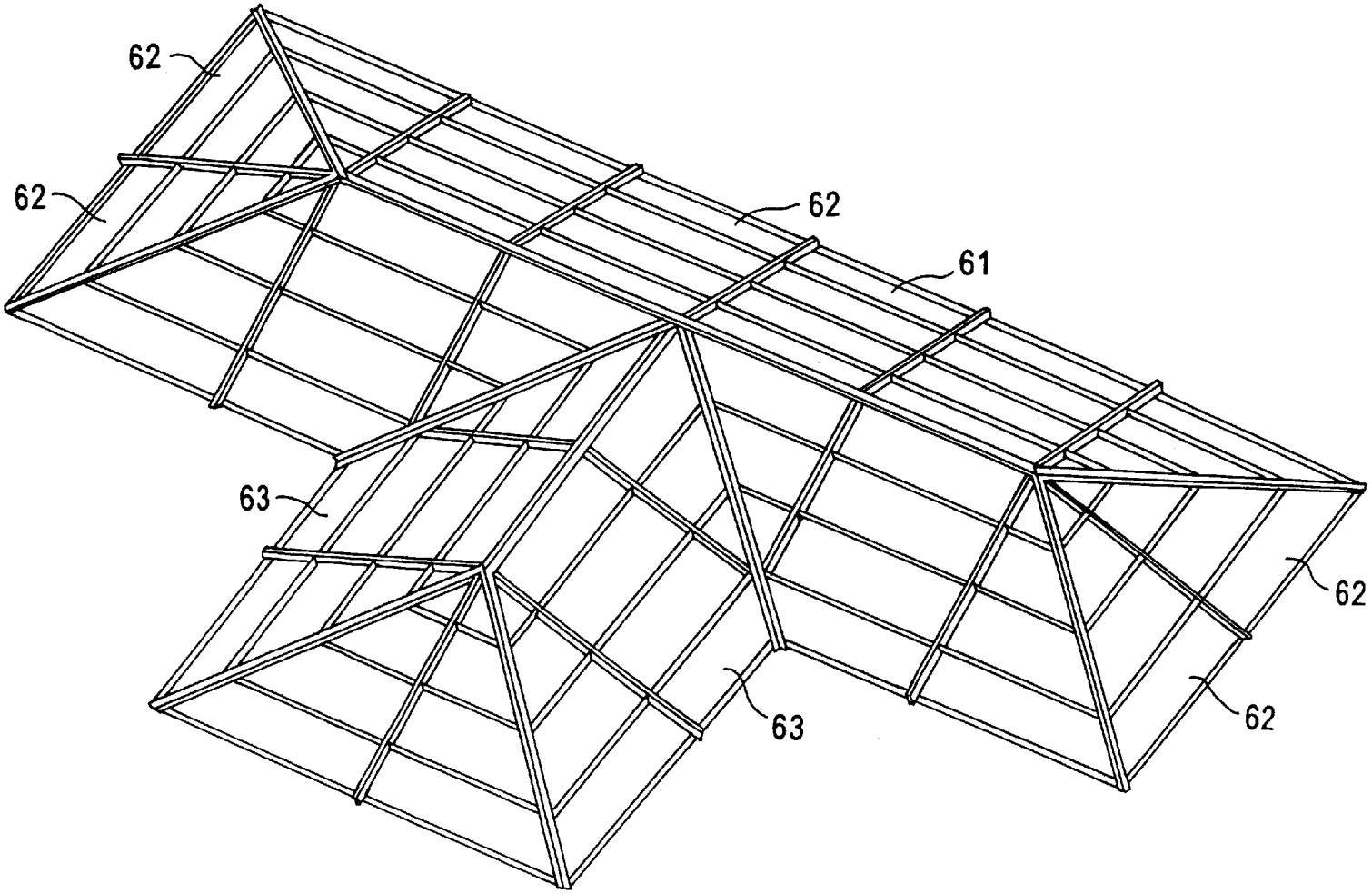
FIG. 7 is a perspective view from above of a typical roofing frame structure.

As further illustrated in FIG. 7 a roof structure 60 may comprise a plurality of rectangular panel frame sections 61, triangular panel frame sections 62 and non-standard panel frame sections 63 which can be relatively simple variations of standard panel frame sections or of more complex form as illustrated in FIG. 14. In each case the panel frame sections, other than their external shape, arm formed in the same configuration with no differences between opposing pairs or left and right hand variants.

The ring frame assemblies 70 illustrated in FIG. 15 are formed at the junction between segments adjacent respective vertical grid planes 25 by bolting the respective frame side members 19 together. These ring frame assemblies 70 may be reinforced by members secured thereto being bracing members 18 inserted into the gaps between adjacent frame side members 19. The reinforcing may be in the form of a truss as illustrated in FIGS. 15(*a*) or 15(*b*), or further uprights 73 may be utilised to provide support as required by the particular structure. It will be seen that the spaces between adjacent frame side members enables intermediate connections to be provided where required without the need for special one-off fabrication of frames with specific intermediate joints.

Figure 2F:
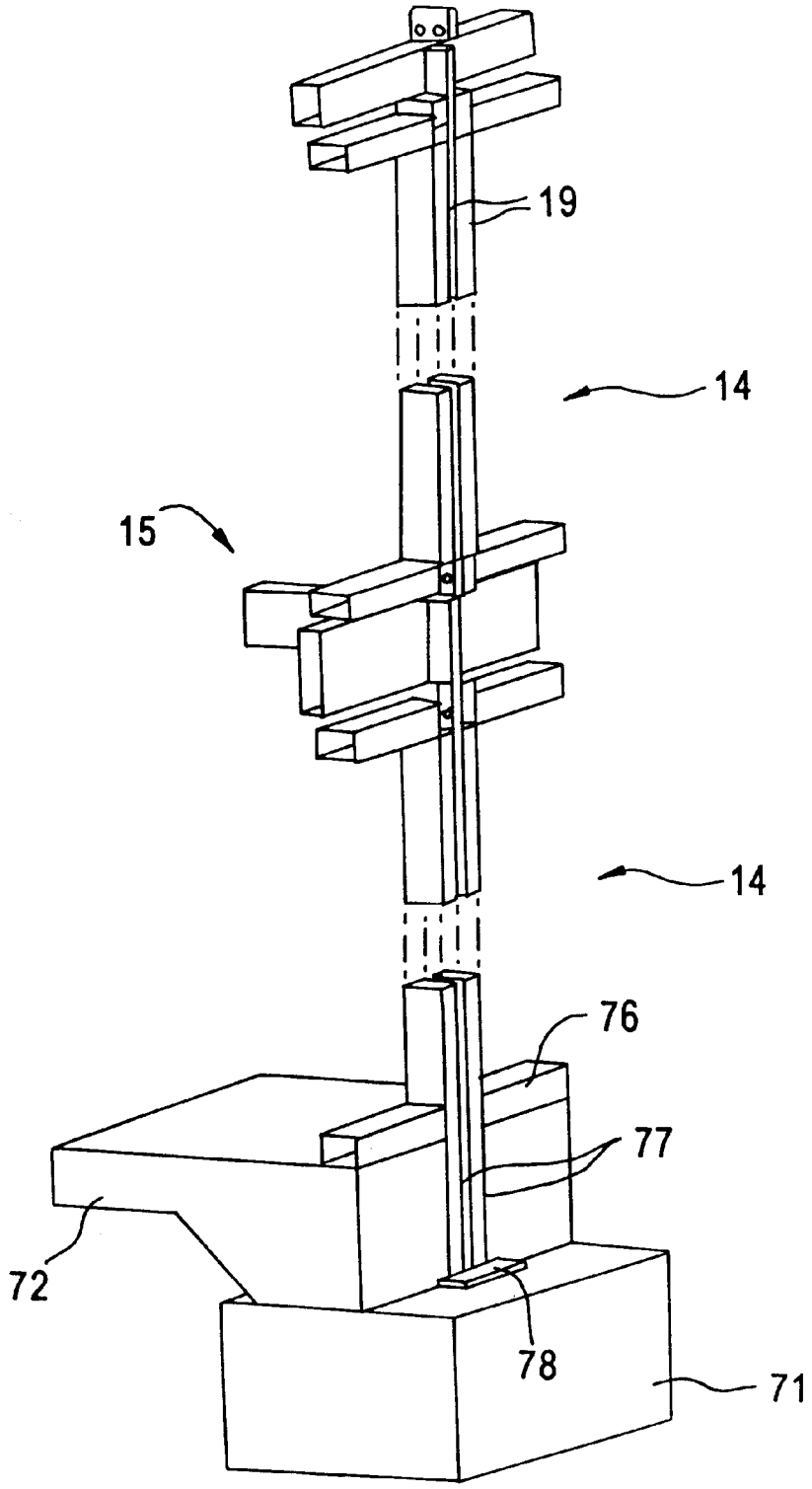
Figure 17:
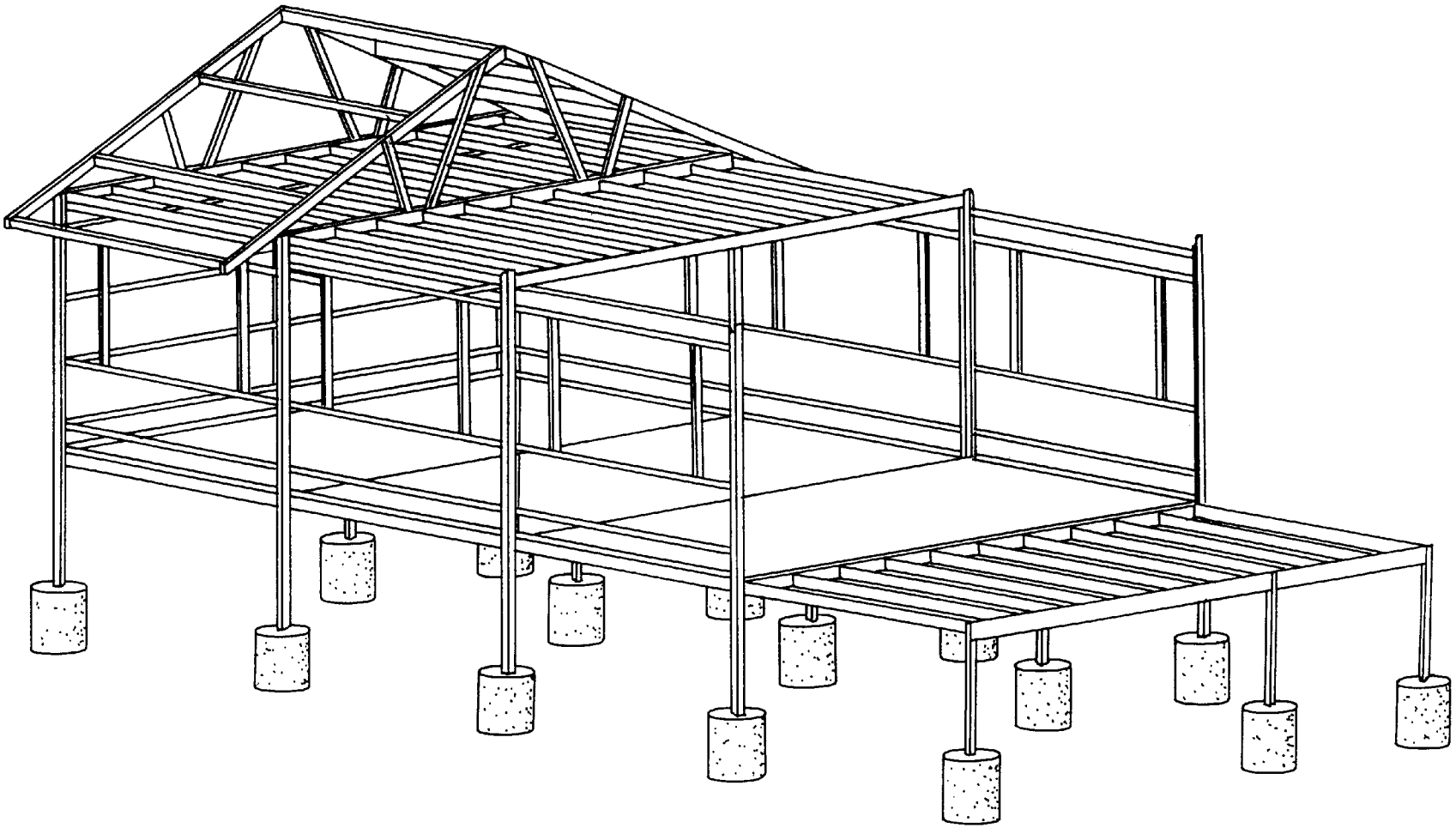
FIG. 17 is a perspective view of a further part-completed building structure.

The structure 10 may be supported on posts 74, as illustrated in FIG. 17 or on a concrete footing 71 as illustrated in FIGS. 2*d* and 2*f*. The lower wall panel frame sections 12/14 are provided with a lower datum rail 76 providing a base level for the concrete slab 72 which may be confined within boxing secured direct to the lower wall panel frame sections 12/14. Suitably the floor slab 72 is poured after the lower uprights 77 of the lower wall panel frame sections 12/14 are welded to the plates 78 captured in the footings 71 and subsequent to final levelling of the elevated floor structure.

As described above significant advantage can be achieved from designing layouts on a square grid, providing uniformity in longitudinal and transverse directions, having grid line spacings equal to the effective span of a roofing sheet, typically 770 mm whereby roof panel frame sections may be covered with roofing sheets which operatively overlap in a weatherproof relationship across the grid planes and join neatly at diagonals.

Figure 16F:
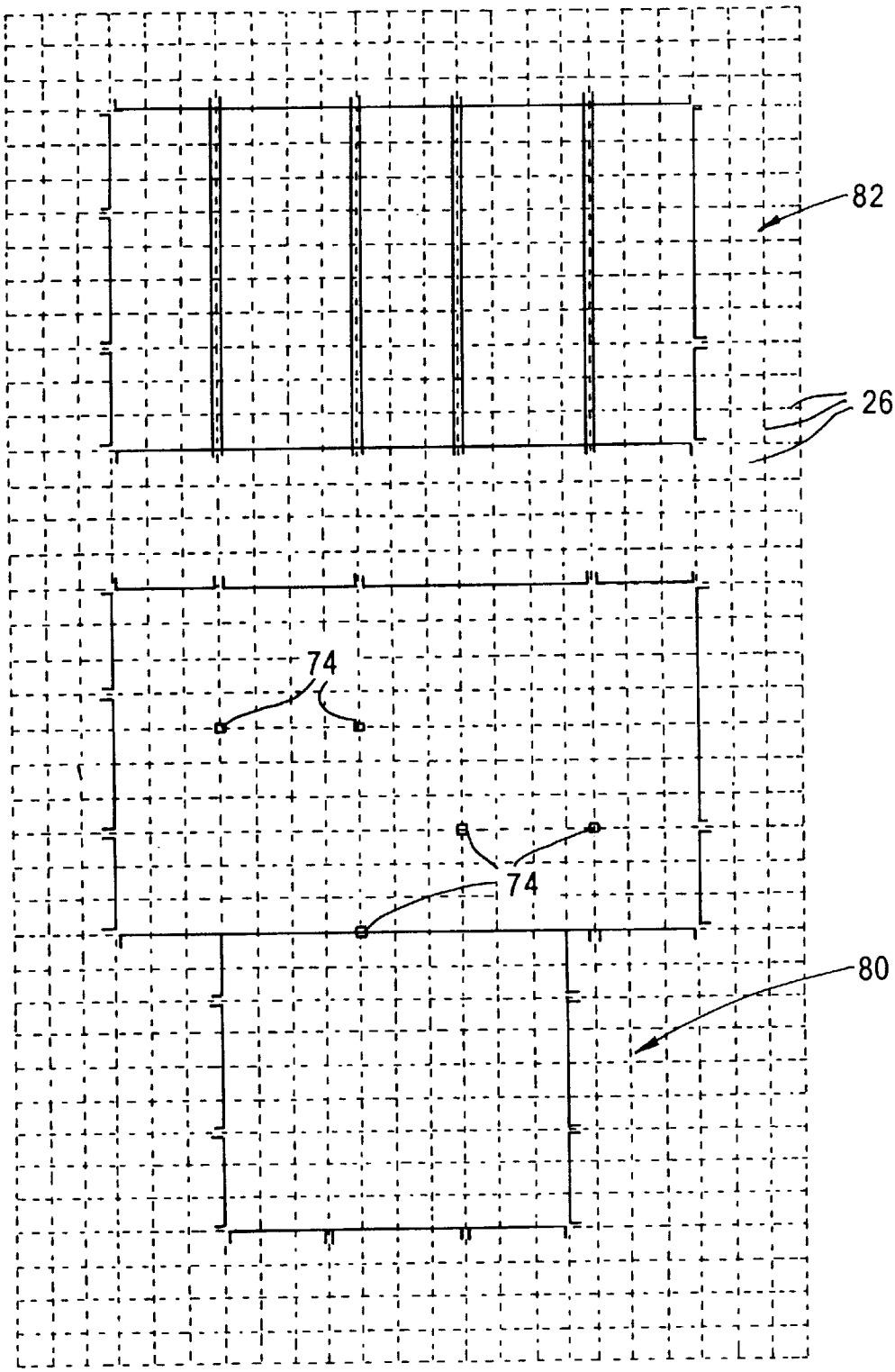
FIG. 16*f* and 16*r* illustrates the use of the grid for floor and roof layout design.
Figure 16R:
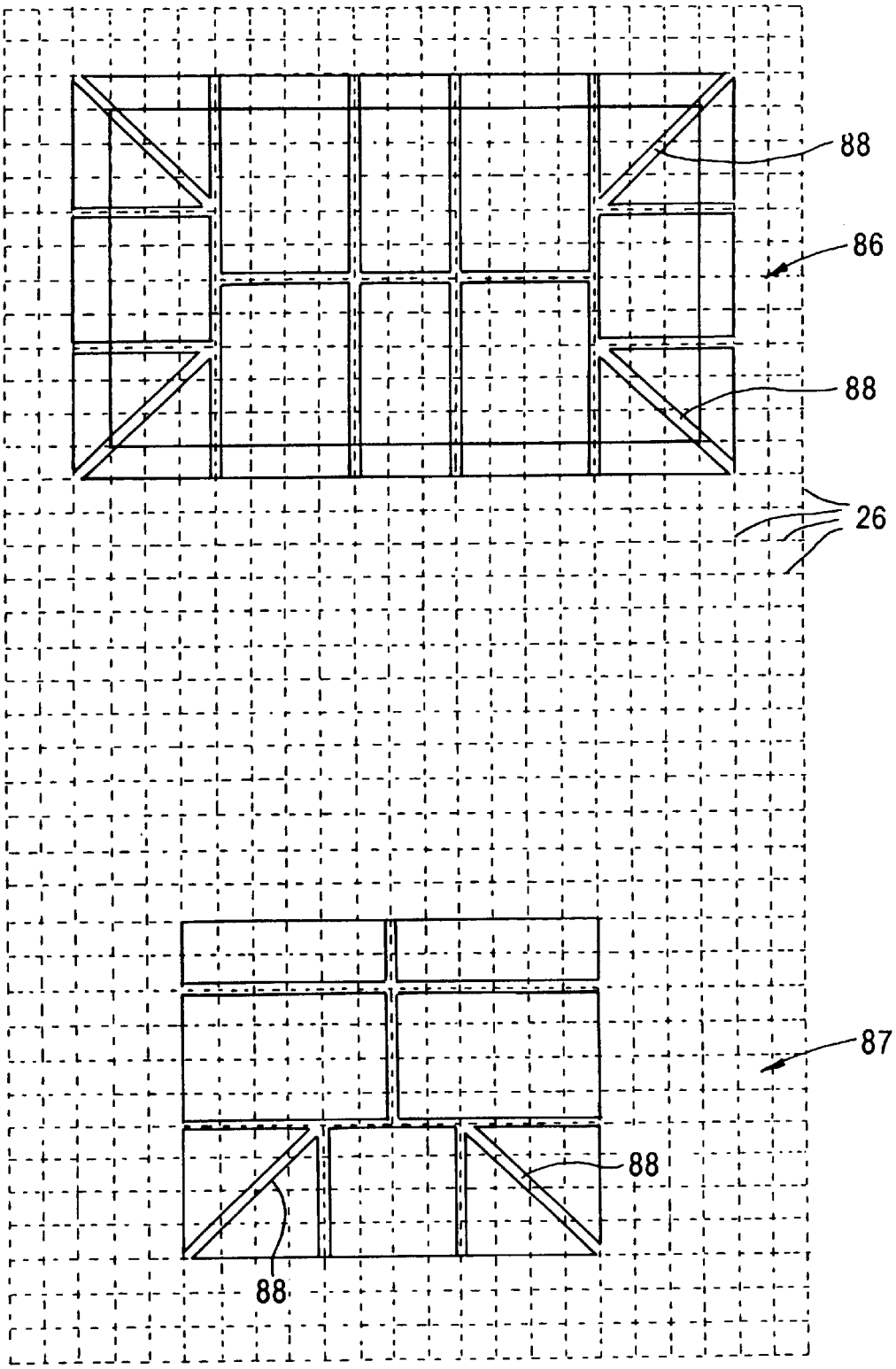

Typically, as illustrated in FIG. 16*f* the floor layout 80 is set out along transverse and longitudinal grid lines 26. The positions of intermediate supporting posts 74 for the elevated floor portion are located at grid intersections and the lengths of the wall panel frame sections 12/14 are determined, some having a length equal to two grid spacings and one having a length equal to seven grid spacings in the illustration. The floor framing 82 for the elevated floor is similarly laid out on the grid. The upper roof layout 86 and the lower roof layout 87 is similarly laid out showing ridges 88 and valleys 89 as diagonals on the grid.

Figure 18:
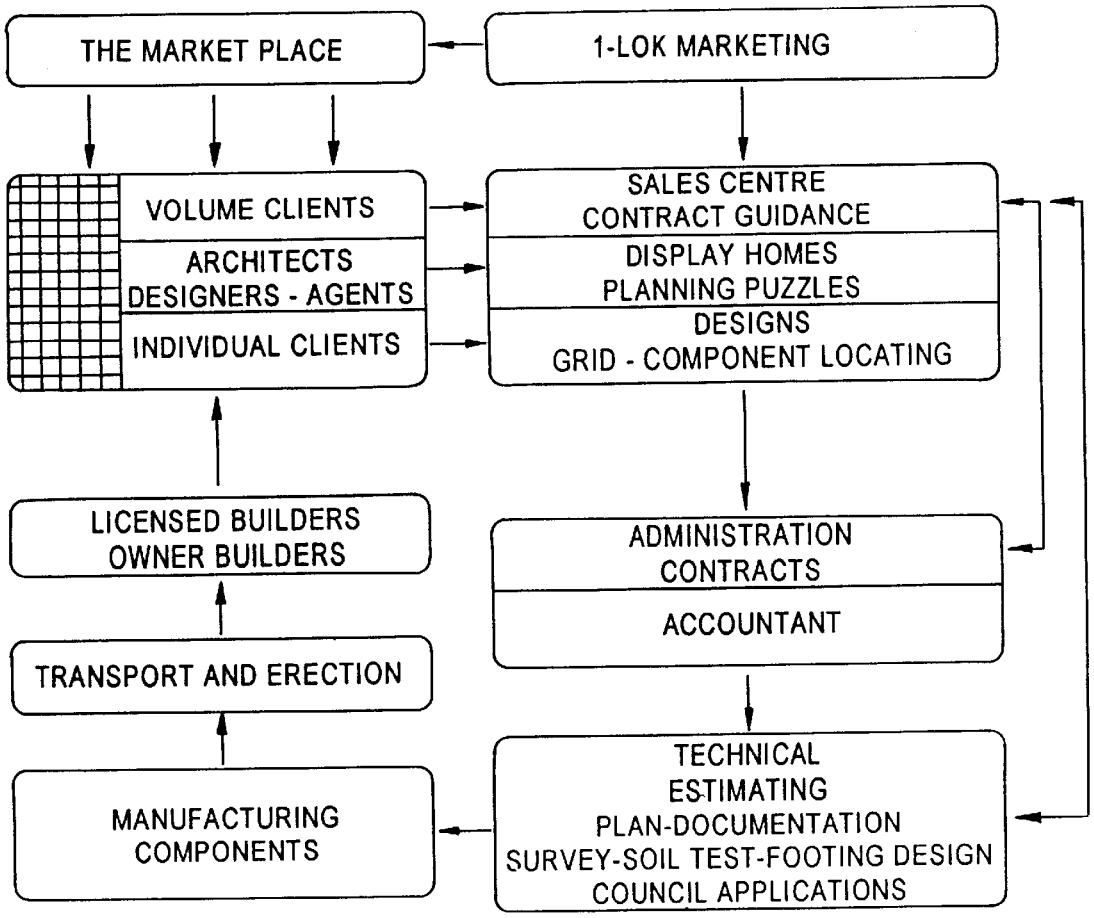
FIG. 18 is a schematic of the preferred form of marketing structure for exploiting structures according to the present invention.

Preferably the grid layout is generated as a computer image and the layouts are formed on screen for the respective functions, such as room layout, matching roof layout and doors and windows, for example, with or by a customer if desired. Using simple CAD techniques, the computer can be programmed to automatically generate a three dimensional drawing of the structure and can unload details of the respective panel frame sections to suit, to workshop metal working apparatus for cost effective and accurate prefabrication of all structural frame assemblies. Furthermore, substantially instantaneous calculations may be automatically computed of the weight of steel, the number of joining members and cost of supply thereof. A typical organizational marketing manufacturing and supply structure is illustrated in the flow chart of FIG. 18.

In an alternate embodiment in FIG. 17, it will be seen that the supporting posts are integral with the upstanding joining plates to which the box section side members of the panel frame sections are through bolted, through factory formed apertures in the side members, by short bolts which are introduced into the apertures from within the box section members and threadingly engaged with the opposite ends of the threaded apertures through the joining members. Where bolts are required to be placed intermediate the ends of side members, the apertures are formed in the abutting faces of the side members and access means, such as access apertures in the opposing wall of the box section members are provided.

The top of the wall side members are similarly connected to joining plates which extend upwardly beyond the upper ends of the panel frame sections to provide preformed bolt connections for the ceiling panel frame sections and the roof panel frame sections. It will also be understood that when the roof panel frame sections of adjacent segments are moved Into position, each may be through bolted to the bracing struts located in the gap between the adjacent ceiling frame panel sections such that a very strong bolted frame assembly is formed which spans the width of the building and is disposed directly above opposed supporting posts. Furthermore, as all components are bolted together, the structure is capable of accommodating lift loadings produced by strong winds as well as normal live loadings and static loadings resulting from the structure itself.

In a typical structure the frame side members 19 are 50 mm wide and the joining plates are 25 mm thick. Thus when bolted together by bolting each side member 19 to a joining plate 21 they form a ring frame assembly which is 125 mm wide. This frame assembly may support a wall from 75 mm in width leaving 25 mm exposed land at each side on which flooring may be supported. The 25 mm joining plate allows a 12 mm bolt penetration from each side and when standard 12 mm diameter bolts are used as this provides a threaded connection length equal to the diameter of the bolts which is sufficiently short to pass through the apertures 30, 32 and 33 from within the side members 19. Furthermore the gap of 25 mm between adjacent side members 19 enables a crane sling to pass therethrough and to be removed therefrom subsequent to the side members 19 being bolted in place. This enables easy crane lifting even if panel frame sections are covered with roof or floor sheeting.

Of course the bolts could be substituted by bayonet type connectors and if desired an internally threaded bolt may pass into a non-threaded aperture from one side and be engaged by a complementary externally threaded bolt passing therein through the opposing side member 19. A simple bolted connection may also be used. However such a connection would not facilitate single panel frame sections to be easily progressively fixed in place, to enable construction to proceed segment by segment.

Suitably the panel frame sections are factory prefabricated with all bolting apertures predrilled and joining plates threaded so that erection is simply a matter of aligning components and screwing them together with bolts. The panel frame sections could be supplied to the building site in a knocked-down form if desired. It is also preferred that dimensions of the individual frame sections is such as to enable them to be readily transported by road to the construction site. If desired, complete segments of the building, such as wet areas, can be fully prefabricated in a factory and shipped with the panel frame sections for on-site erection. In this manner, lock-up segments can be immediately installed on site and provide bracing for the remaining building segments to be added thereto.

If desired, the components of each segment may be shipped to the construction site as transportable modules when and as required and if desired with cranked joining brackets extending down from the wall panel frame sections to engage the outer faces of the floor panel frame sections such that partial bolting of the components together enables them to fold about the partial connections. That is the side wall panel frame sections may be pivotally connected to the ends of the floor panel frame sections such that they may pivot between an overlying attitude and an attitude at which they extend at right angles to one another there further bolting of the brackets will rigidify the bolted connection.

Typically, the shorter side wail panel frame sections would overly respective ends of the longer wall panel frame sections and if desired, with the ceiling panel frame sections and the roof panel frame sections sandwiched therebetween to form a compact shipping module which may be readily unfolded, erected and bolted together to provide a rigid building segment.

The floor and coiling panel frame sections are suitably identical in configuration and may he made identical in strength by making the members of the same material whereby the structure may be readily formed as a multi storey structure. By maintaining substantial identity of panel frame forms, manufacturing cost may be minimised. Different design loadings may be provided by varying member size and/or the wall thickness of frame member sections. Uniformity of bolt size, including length will also assist in ease of assembly and stock control.

If desired floor and roof panel frame sections can be supplied pre-sheeted and may have insulating panels, preformed to a standard width, inserted between the rung frame members. Floor sheeting such as plywood or particle board or the like, pre fitted in the factory has edge protection to the extent that the sheeting terminates short of the side edge of the panel frame sections. Also as the adjacent frame side members only touch joining members bows or non-linearity therein will not cause "creep": along the length of a well. Thus the segmented lengths are readily maintained to the standard without incurring the penalty of low allowable tolerances at each welded joint. Furthermore the spacing of adjacent frame side members permits intermediate columns to be structurally included after the main structure has ben erected.

In addition wall panel frame sections can span 1, 2 or more floor frames or roof frames giving flexibility of design not usual in modular designs, without sacrificing ease of costing and shop fabrication.

It will of course be realised that the above has ben given only by way of illustrative example of the invention and that all such modifications and variations thereto as would be apparent to persons skilled in the art such as making special one-off joints or frames or utilizing only some of the novel aspects of the building system illustrated, are deemed to fall within the broad scope and ambit of the invention as is defined in the appended claims.

I claim:

1. A building structure formed from transportable metal prefabricated panel frame sections, said building structure comprising:

a plurality of substantially planar frame assemblies, each said frame assembly being formed from a plurality of substantially identical panel frame sections including frame side members having upper and lower ends, said panel frame sections being arranged in each of said frame assemblies in substantially coplanar juxtaposition with the frame side members of adjacent panel frame sections; and a plurality of joining members located respectively between adjacent frame side members proximate at least one of said upper and said lower ends thereof and fastened thereto for rigidly fastening said adjacent frame sides members to one another to thereby rigidly fasten juxtaposed panel frame sections to one another to form a frame assembly, such said joining member extending longitudinally beyond said upper or said lower end of said frame side members for interconnecting said frame assembly to another frame assembly by fastening to the upper or lower end of respective adjacent side frame members of juxtaposed panel frame sections in said another frame assembly; wherein said joining members are formed with threaded apertures therethrough, each said threaded aperture having a length enabling operative securement thereto of opposing connecting bolts inserted from each end of the aperture.

2. The building structure as claimed in claim 1, wherein said plurality of frame assemblies are selected from the group comprising wall frames, floor frames and roof frames.

3. The building structure as claimed in claim 2, wherein a wall frame is connected to a floor frame and a roof frame.

4. A building structure as claimed in claim 3, and including:

a floor support disposed beneath said interconnected frame side members;

wherein the interconnected frame side members in said wall frame constitute load bearing members for transferring roof, wall and floor loads directly to said floor support in a substantially straight-line load path.

5. A building structure formed from transportable metal prefabricated panel frame sections, said building structure comprising:

a plurality of substantially planar frame assemblies, each said frame assembly being formed from a plurality of substantially identical panel frame sections including frame side members having upper and lower ends, said panel frame sections being arranged in each of said frame assemblies in substantially coplanar juxtaposition with the frame side members of adjacent panel frame sections; and a plurality of joining members located respectively between adjacent frame side members proximate at least one of said upper and said lower ends thereof and fastened thereto for rigidly fastening said adjacent frame sides members to one another to thereby rigidly fasten juxtaposed panel frame sections to one another to form a frame assembly, such said Joining member extending longitudinally beyond said upper or said lower end of said frame side members for interconnecting said frame assembly to another frame assembly by fastening to the upper or lower end of respective adjacent side frame members of juxtaposed panel frame sections in said another frame assembly, wherein said joining members are plate-like members to which each of the adjacent panel frame sections are mechanically fastened, wherein said plate-like members are formed with threaded apertures therethrough, each said threaded aperture having a length enabling operative securement thereto of opposing connecting bolts inserted from each end of the aperture.

6. A building structure as claimed in claim 5, wherein the upper and lower ends of the frame side members have apertures for receiving said connecting bolts therethrough for rigidly fastening a side frame member to a joining member.

7. A building structure as claimed in claim 5, wherein said plate-like members have a thickness equal to one half the thickness of each adjacent frame side member.

8. A building structure as claimed in claim 3, wherein the spaces between interconnected panel frame sections in the floor, wall and roof panels are arranged to be medially intersected by respective vertical grid planes extending at right angles to the panel frame sections, said grid planes having an array of intersecting equidistant grid lines.

9. A building structure as claimed in claim 8, wherein the width of a panel frame section and a joining member is a multiple of the distance between said grid lines.

10. A building structure as claimed in claim 9, wherein said panel frame sections are formed as ladder type frames with rung frame members.

11. A building structure as claimed in claim 9, wherein the distance between grid planes is equal to the effective span of a roofing sheet.

12. A building structure as claimed in claim 11, wherein the grid is a square grid.

13. A method of providing an individually designed building structure, said method including:

providing a plan grid having square grid line spacings equal to the effective cover width of standard roofing panels;

designing the floor plan by arranging all external supporting walls to lie along a respective grid line, and designing a roof layout with all valley lines and ridge lines extending along a grid line or a diagonal of the grid;

wherein said building structure is as defined in claim 1 and the width of a wall panel frame section and a joining member is a multiple of the distance between said grid lines.

* * * * *